US007003825B1

(12) United States Patent
Levings

(10) Patent No.: US 7,003,825 B1
(45) Date of Patent: Feb. 28, 2006

(54) CRUCIFORM POCKETED BLANKET CONSTRUCTION

(76) Inventor: James Levings, 1901 Columbia Rd., #501, Washington, DC (US) 20009

( * ) Notice: Subject to any disclaimer, the term of this patent is extended or adjusted under 35 U.S.C. 154(b) by 0 days.

(21) Appl. No.: 10/855,100

(22) Filed: May 27, 2004

(51) Int. Cl.
*A41B 13/06* (2006.01)
*A47G 9/02* (2006.01)
*B60N 3/00* (2006.01)

(52) U.S. Cl. ..... 5/482; 2/69.5; 5/494; 296/81

(58) Field of Classification Search ..... 5/482, 5/485, 494; 2/69, 69.5; 296/81
See application file for complete search history.

(56) References Cited

U.S. PATENT DOCUMENTS 1,639,156 A * 8/1927 Wilmert ..... 5/502
2,096,913 A * 10/1937 Munro ..... 5/413 R
2,444,652 A * 7/1948 Gracia ..... 2/69.5
4,383,335 A * 5/1983 Slocum ..... 2/114
4,897,885 A * 2/1990 Lunt ..... 2/69.5
5,046,204 A * 9/1991 Mohler ..... 5/413 R
5,058,226 A * 10/1991 Crosby ..... 5/494
5,129,406 A * 7/1992 Magnusen et al. ..... 128/873
5,781,946 A * 7/1998 McEntire et al. ..... 5/482
5,852,827 A * 12/1998 Lear ..... 2/69.5
D405,635 S * 2/1999 Cohen et al. ..... D6/603
5,970,542 A 10/1999 Mays ..... 5/485
D448,914 S * 10/2001 Caudill ..... D2/719
D456,661 S * 5/2002 Henegan ..... D6/608
6,643,870 B1 11/2003 Bertrand ..... 5/482
6,839,924 B1 * 1/2005 Sims ..... 5/494
2001/0032360 A1 10/2001 Bertrand ..... 5/482
2003/0061659 A1 4/2003 Dunlap et al. ..... 5/485

* cited by examiner

*Primary Examiner*—Thomas B. Will
*Assistant Examiner*—Tara L. Mayo
(74) *Attorney, Agent, or Firm*—Sturm & Fix LLP

(57) ABSTRACT

A blanket construction (10) primarily designed for airline passengers wherein, the construction (10) includes a blanket member (20) having a vertical stem portion (23) including a criss-cross pocket arrangement (27) on its lower end (25) that is adapted to receive a liner element (50) and a horizontal cross-arm portion (22) wherein, the stem portion (23) is adapted to receive the legs and lower torso of the user and the cross arm portion (22) is adapted to surround the upper torso and arms of the user.

7 Claims, 3 Drawing Sheets

CRUCIFORM POCKETED BLANKET CONSTRUCTION

CROSS REFERENCE TO RELATED APPLICATIONS

Not applicable.

BACKGROUND OF THE INVENTION

1. Field of the Invention

The present invention relates to the field of blanket constructions in general and in particular to a blanket construction that is specifically designed for a user disposed in a generally upright sitting position.

2. Description of Related Art

As can be seen by reference to the following U.S. Pat. Nos. 5,970,542 and 6,643,870, as well as, published patent applications U.S. 2003/0061659 A1 and U.S. 2001/0032360 A1, the prior art is replete with myriad and diverse blanket arrangements.

While all of the aforementioned prior art constructions are more than adequate for the basic purpose and function for which they have been specifically designed, they are uniformly deficient with respect to their failure to provide a simple, efficient, and practical blanket construction that is specifically designed to accommodate a user sitting in a generally upright disposition such as would be encountered on an airliner.

As most of today's commercial airline passengers are all too well aware, the blankets that are provided to the passengers offer only minimal warmth and/or coverage and, while this problem does not pose a life threatening situation for the passenger, it is yet another example of how a small amount of thoughtfulness and even a minimal expenditure in time, effort, and money could reap major rewards in customer comfort and satisfaction.

As a consequence of the foregoing situation, there has existed a longstanding need in the airline industry for a new and improved blanket construction that addresses virtually all of the shortcomings of today's airline blankets in a simple, practical and straightforward manner and, the provision of such a construction is the stated objective of the present invention.

BRIEF SUMMARY OF THE INVENTION

Briefly stated, the blanket construction that forms the basis of the present invention comprises a general cruciform shaped blanket member including a stem portion and a cross arm portion.

As will be explained in greater detail further on in the specification, the stem portion is provided with a criss-cross pocket arrangement dimensioned to receive the user's legs and feet whereas, the arms of the cross arm portion are arranged to surround the user's arms and upper torso.

The major benefits of this arrangement being that the criss-cross pocket arrangement facilitates the insertion of the user's feet into the bottom of the blanket construction to block out drafts on the back of the user's legs and the arms of the cross arm portion may be selectively draped across different portions of the user's upper torso so that the user can customize which portions of their upper torso and arms are covered and/or uncovered.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
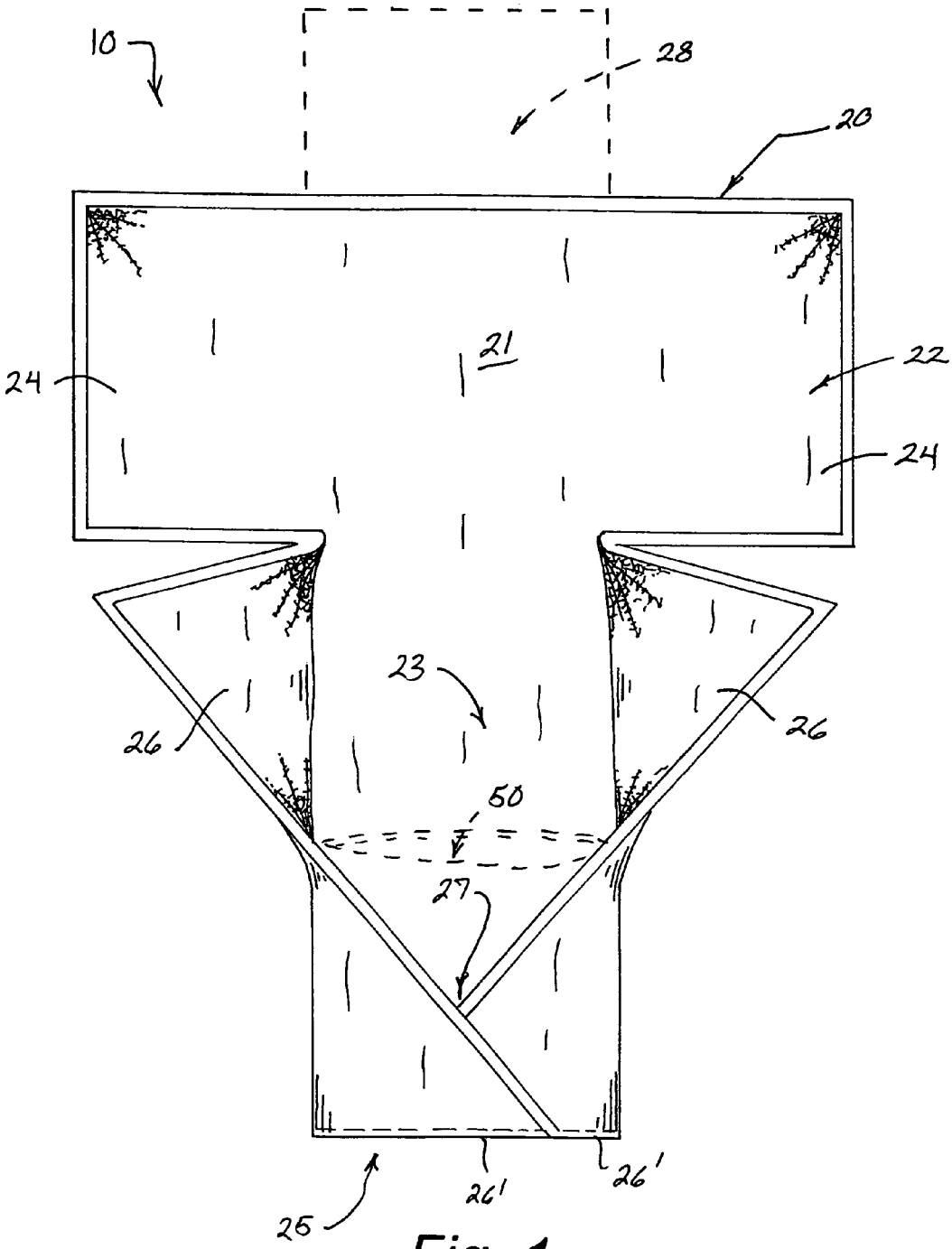
FIG. 1 is a front plan view of the blanket construction it its partially open disposition.
Figure 2:
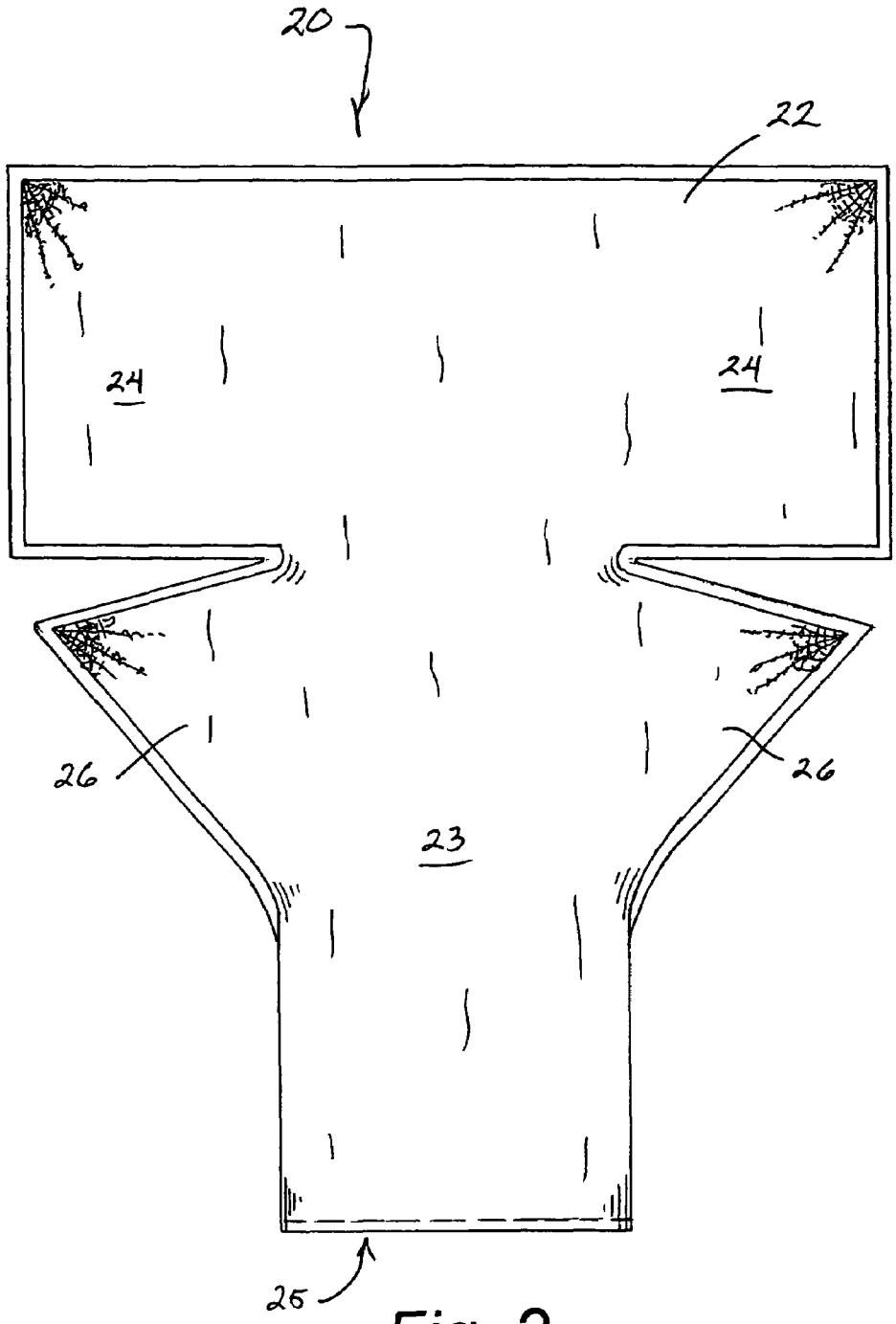
FIG. 2 is a rear plan view of the blanket construction in its partially open disposition.

As can be seen by reference to the drawings, and in particular to FIGS. 1 and 2, the cruciform pocketed blanket construction that forms the basis of the present invention is designated generally by the reference number 10. The blanket construction 10 comprises a generally cruciform shaped blanket member 20 fabricated from a single contoured sheet of material 21 and having a horizontal cross arm portion 22 and a vertical stem portion 25.

As can be seen by reference to FIGS. 1 and 2, the cross arm portion 22 comprises a pair of mirror image elongated arms 24 24 that are formed integrally with the stem portion 23 the lower end of which defines a criss-cross pocket arrangement that will be explained presently.

As can also be appreciated by reference to FIGS. 1 and 2, the stem portion 23 has a lower end 25 that is defined by two mirror image, generally rectangular panels 26 26 that are folded over and joined on their bottom edges 26' 26' to the remainder of the bottom of the lower end 25 of the stem portion to create the criss-cross pocket arrangement designated generally as 27.

In addition, as shown in FIG. 1 in the first version of the preferred embodiment, the vertical stem portion 23 is provided with a head panel depicted in phantom 28 to produce a generally cruciform finished configuration whereas, in the second version of the preferred embodiment depicted in FIG. 2, the head panel is absent so that the blanket construction has a generally T-shaped configuration.

Figure 3:
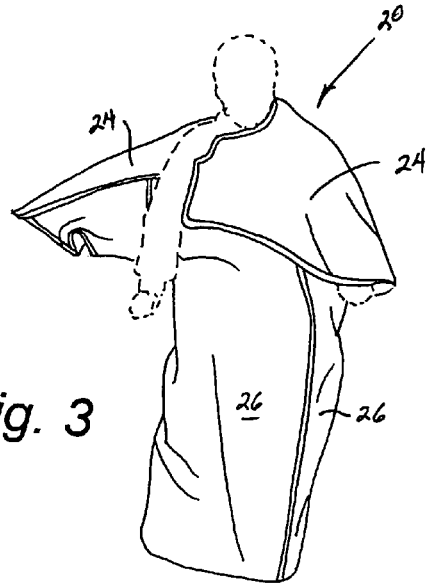
FIG. 3 is a perspective view of the blanket construction substantially enveloping the user.
Figure 4:
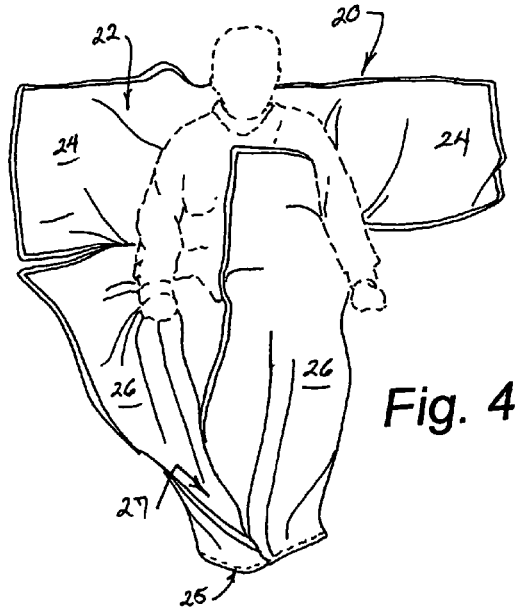
FIG. 4 is a perspective view of the blanket construction partially enveloping the user; and, FIG. 5 is a perspective view of the blanket construction minimally enveloping the user.
Figure 5:
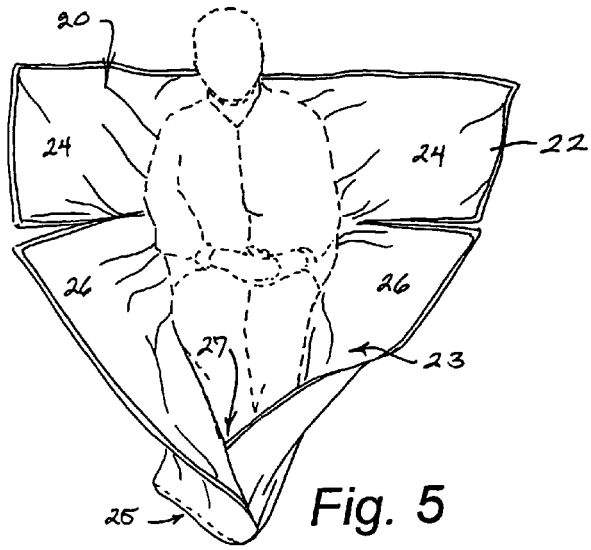

At this juncture, it should be noted that as depicted in FIGS. 3 through 5, the pocket 27 on the lower end 25 of the stem portion 23 of the blanket construction 10 easily receives the user's feet and effectively covers the user's lower legs whereas, the arms 24 24 of the cross arm portion 22 of the blanket member 20 may be draped in a variety of configurations to cover and surround the user's arms and upper torso in a snug and warm fashion.

It should also be noted that this invention further contemplates the provision of a removable liner element 50 depicted in phantom such that the user can place their feet within the pocket 27 without having to take off their shoes wherein, the liner element 50 will prolong the useful life of the blanket construction 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A blanket construction primarily designed for airline passengers wherein the blanket construction comprises:

a contoured blanket member having a vertical stem portion and a horizontal cross-arm portion provided with a pair of elongated arms formed integrally with, and in the same plane as, the vertical stem portion wherein, the stem portion has a lower end that includes two generally rectangular panels wherein, the bottom edges of each of the panels and the bottom edge of the vertical stem portion are joined together to form a criss-cross pocket arrangement; and, wherein, the generally rectangular panels are disposed in a different plane than said stem portion and the cross-arm portion.

2. The construction as in claim 1 wherein, said blanket member has a generally T-shaped configuration.

3. The construction as in claim 2 wherein, the criss-cross pocket arrangement is further provided with a removable liner element.

4. The construction as in claim 1 wherein, said stem portion further includes a head panel that extends above, and in the same plane as, the cross-arm portion.

5. The construction as in claim 4 wherein, said blanket member has a generally cruciform configuration.

6. The construction as in claim 4 wherein, the criss-cross pocket arrangement is further provided with a removable liner element.

7. The construction as in claim 1 wherein, the criss-cross pocket arrangement is further provided with a removable liner element.

* * * * *